US007997644B2

(12) United States Patent
Hoffman et al.

(10) Patent No.: US 7,997,644 B2
(45) Date of Patent: Aug. 16, 2011

(54) GLIDING-RECLINING SEATING UNIT WITH POWER ACTUATOR

(75) Inventors: D. Stephen Hoffman, High Point, NC (US); Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 275 days.

(21) Appl. No.: 12/276,567

(22) Filed: Nov. 24, 2008

(65) Prior Publication Data

US 2010/0127555 A1 May 27, 2010

(51) Int. Cl.
*A47C 1/031* (2006.01)
*A47C 1/00* (2006.01)

(52) U.S. Cl. ..... 297/85 M; 297/344.21

(58) Field of Classification Search ..... 297/85 M, 297/68, 342, 330, 344.21, 344.24, 344.26
See application file for complete search history.

(56) References Cited

U.S. PATENT DOCUMENTS

| | | | |
|---|---|---|---|
| 507,270 | A | 10/1893 | Hirschfeld |
| 2,526,623 | A | 10/1950 | Maurer |
| 2,714,922 | A | 8/1955 | McKibban et al. |
| 3,016,264 | A | 1/1962 | Hughes |
| 3,147,038 | A | 9/1964 | Barabas |
| 3,383,135 | A | 5/1968 | Posh |
| 3,622,202 | A | 11/1971 | Brown |
| 3,863,980 | A | 2/1975 | Ciner |
| 4,307,912 | A | 12/1981 | Watt et al. |

(Continued)

FOREIGN PATENT DOCUMENTS

GB 2 106 777 A 4/1983

OTHER PUBLICATIONS

Lusch Brochure: "Functional Fitting and Tubular steel frames for Relaxing Chairs (11 pages), Functional Fittings for Sofabeds and Beds (10 pages), Bed Fitting (5 pages) and Upholstery joints and accessories for furniture (9 pages)", (available before Apr. 7, 2006).

(Continued)

*Primary Examiner* — Milton Nelson, Jr.
(74) *Attorney, Agent, or Firm* — Myers Bigel Sibley & Sajovec

(57) ABSTRACT

A gliding and reclining seating unit includes: a base unit with a first bearing surface; a generally horizontally-disposed seat positioned above the base; a generally upright backrest positioned above the base and substantially rearward of the seat; an extendable ottoman; a reclining mechanism attached to the seat, the backrest, the ottoman and the base unit, the reclining mechanism comprising a plurality of pivotally interconnected links; a gliding mechanism attached to the base unit and the reclining mechanism, the gliding mechanism being configured to enable the seat, backrest and reclining mechanism to glide relative to the base unit along a longitudinal path responsive to a longitudinally-directed force; and a power actuating unit attached to the reclining mechanism. The actuating unit is configured to move the chair between (a) an upright position, in which the seat is generally horizontally disposed, the backrest is generally vertically disposed, and the ottoman are generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases.

23 Claims, 5 Drawing Sheets

U.S. PATENT DOCUMENTS

| | | | | |
|---|---|---|---|---|
| 4,386,803 | A | 6/1983 | Gilderbloom | |
| 4,674,794 | A | 6/1987 | Pine | |
| 4,681,365 | A | 7/1987 | Pine | |
| 4,682,815 | A | 7/1987 | Steifensand | |
| 4,691,964 | A | 9/1987 | Morgan | |
| 4,696,512 | A | 9/1987 | Burnett et al. | |
| 4,722,566 | A | 2/1988 | Castellini | |
| 4,813,743 | A | 3/1989 | Mizelle | |
| 4,915,444 | A | 4/1990 | Rogers, Jr. | |
| 5,007,679 | A | 4/1991 | Mizelle | |
| 5,086,769 | A | 2/1992 | Vianello et al. | |
| 5,704,686 | A * | 1/1998 | May | 297/281 |
| 5,884,970 | A | 3/1999 | Howard | |
| 5,931,535 | A | 8/1999 | Sweet | |
| 6,491,342 | B1 | 12/2002 | Smith | |
| 6,540,291 | B2 | 4/2003 | Hoffman et al. | |
| 6,612,650 | B1 | 9/2003 | Ambrosio et al. | |
| 6,840,575 | B2 | 1/2005 | Hesse | |
| 6,843,531 | B2 * | 1/2005 | Williams | 297/337 |
| 6,893,085 | B2 | 5/2005 | LaPointe et al. | |
| 6,896,323 | B2 * | 5/2005 | LaPointe et al. | 297/85 M |
| 6,948,777 | B2 | 9/2005 | Marshall et al. | |
| 7,083,235 | B2 | 8/2006 | Grimm et al. | |
| 7,188,904 | B2 | 3/2007 | Bruck et al. | |
| 7,293,834 | B2 | 11/2007 | Riach et al. | |
| 7,311,359 | B2 | 12/2007 | Smith | |
| 2006/0082195 | A1 | 4/2006 | Jiang | |
| 2011/0018331 | A1 * | 1/2011 | Murphy et al. | 297/85 R |

OTHER PUBLICATIONS

"Stawett Functional Bed Mechanisms Brochure", pp. 3-93 (2001).

* cited by examiner

GLIDING-RECLINING SEATING UNIT WITH POWER ACTUATOR

FIELD OF THE INVENTION

This invention relates generally to seating units, and relates more particularly to reclining seating units with rocking capability.

BACKGROUND OF THE INVENTION

Recliner chairs and other reclining seating units have proven to be popular with consumers. These seating units typically move from an upright position, in which the backrest is generally upright, to one or more reclined positions, in which the backrest pivots to be less upright. The movement of the seating unit between the upright and reclined positions is typically controlled by a pair of matching reclining mechanisms that are attached to the seat, backrest and base of the chair.

In recent years, furniture designers have looked for alternatives to rocking chairs that can provide a similarly relaxing repetitive motion. One alternative has been the gliding chair, or "glider", which includes structure that enables the seat portion of the chair to "glide" forwardly and rearwardly relative to its base to mimic generally the rocking motion of a rocking chair. Often the gliding structure comprises a set of swing links (usually two at the front of the chair, and two at the rear) that are pivotally attached at their upper ends to the base and extend downwardly therefrom to attach to a structure, such as a mounting bracket, that is attached to the seat. In this configuration, the seat is suspended from the base and is free to swing forwardly and rearwardly in a double pendulum-type motion in response to a forwardly or rearwardly-directed force applied by a seated occupant. The gliding path of the chair is controlled by the configuration and mounting of the swing links. These chairs can be constructed to resemble traditional rocking chairs and thus are quite popular.

Reclining capability has been combined with gliding capability in a single unit to provide a chair that both reclines and glides. This chair includes a reclining mechanism that enables it to move between upright and one or more reclined positions, and further includes the aforementioned swing links attached between the base and the seat, armrests, or mechanism itself to enable the chair to glide. Examples of such chairs are illustrated and described in U.S. Pat. Nos. 4,536,029 and 4,544,201, both to Rogers, Jr., the disclosures of which are hereby incorporated herein by reference in their entireties.

Although they are already popular seating units, it may be desirable to provide additional functionality to glider-recliners.

SUMMARY OF THE INVENTION

As a first aspect, embodiments of the present invention are direction to a gliding and reclining seating unit. The glider-recliner comprises: a base unit with a first bearing surface; a generally horizontally-disposed seat positioned above the base; a generally upright backrest positioned above the base and substantially rearward of the seat; an extendable ottoman; a reclining mechanism attached to the seat, the backrest, the ottoman and the base unit, the reclining mechanism comprising a plurality of pivotally interconnected links; a gliding mechanism attached to the base unit and the reclining mechanism, the gliding mechanism being configured to enable the seat, backrest and reclining mechanism to glide relative to the base unit along a longitudinal path responsive to a longitudinally-directed force; and a power actuating unit attached to the reclining mechanism. The actuating unit is configured to move the chair between (a) an upright position, in which the seat is generally horizontally disposed, the backrest is generally vertically disposed, and the ottoman are generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases.

As a second aspect, embodiments of the present invention are directed to a gliding and reclining seating unit, comprising: a base unit with a first bearing surface; a generally horizontally-disposed seat positioned above the base; a generally upright backrest positioned above the base and substantially rearward of the seat; an extendable ottoman; a reclining mechanism attached to the seat, the backrest, the ottoman and the base unit, the reclining mechanism comprising a plurality of pivotally interconnected links; a gliding mechanism attached to the base unit and the reclining mechanism, the gliding mechanism being configured to enable the seat, backrest and reclining mechanism to glide relative to the base unit along a longitudinal path responsive to a longitudinally-directed force; and a linear actuator attached to the reclining mechanism. The linear actuator is configured to move the chair between (a) an upright position, in which the seat is generally horizontally disposed, the backrest is generally vertically disposed, and the ottoman are generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases.

As a third aspect, embodiments of the present invention are directed to a gliding and reclining seating unit, comprising: a base unit with a first bearing surface; a generally horizontally-disposed seat positioned above the base; a generally upright backrest positioned above the base and substantially rearward of the seat; an extendable ottoman; a reclining mechanism attached to the seat, the backrest, the ottoman and the base unit, the reclining mechanism comprising a plurality of pivotally interconnected links; a gliding mechanism attached to the base unit and the reclining mechanism, the gliding mechanism being configured to enable the seat, backrest and reclining mechanism to glide relative to the base unit along a longitudinal path responsive to a longitudinally-directed force; and a linear actuator attached to the reclining mechanism. The linear actuator is configured to move the chair between (a) an upright position, in which the seat is generally horizontally disposed, the backrest is generally vertically disposed, and the ottoman are generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases. The reclining mechanism includes a pantographic linkage on which the ottoman is mounted. In the TV and fully reclined positions, pivots between links of the pantographic linkage form a near over-center arrangement that locks the ottoman in position. The reclining mechanism also includes a backpost that is fixed relative to the backrest, a mounting bracket that is fixed relative to the rocker cams and pivotally attached to the backpost, and a seat adapter that is fixed relative to the seat and pivotally attached to the backpost.

As a fourth aspect, embodiments of the present invention are directed to a gliding and reclining seating unit comprising: a base unit with a first bearing surface; a generally horizontally-disposed seat positioned above the base; a generally upright backrest positioned above the base and substantially rearward of the seat; an extendable ottoman; a reclining mechanism attached to the seat, the backrest, the ottoman and the base unit, the reclining mechanism comprising a plurality of pivotally interconnected links; a gliding mechanism attached to the base unit and the reclining mechanism, the gliding mechanism being configured to enable the seat, backrest and reclining mechanism to glide relative to the base unit along a longitudinal path responsive to a longitudinally-directed force; and a power actuating unit attached to the reclining mechanism. The actuating unit is configured to move the chair between (a) an upright position, in which the seat is generally horizontally disposed, the backrest is generally vertically disposed, and the ottoman are generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases. The reclining mechanism includes a backpost fixed relative to the backrest and a sequencer plate pivotally interconnected with the backrest and with the remainder of the reclining mechanism, and wherein the sequencer plate rotates in a first rotative direction relative to the backrest when the seating unit moves from the upright position to the TV position, and wherein the backrest rotates relative to the sequencer plate in the first rotative direction when the seating unit moves from the TV position to the fully reclined position.

DETAILED DESCRIPTION OF EMBODIMENTS OF THE INVENTION

Figure 1:
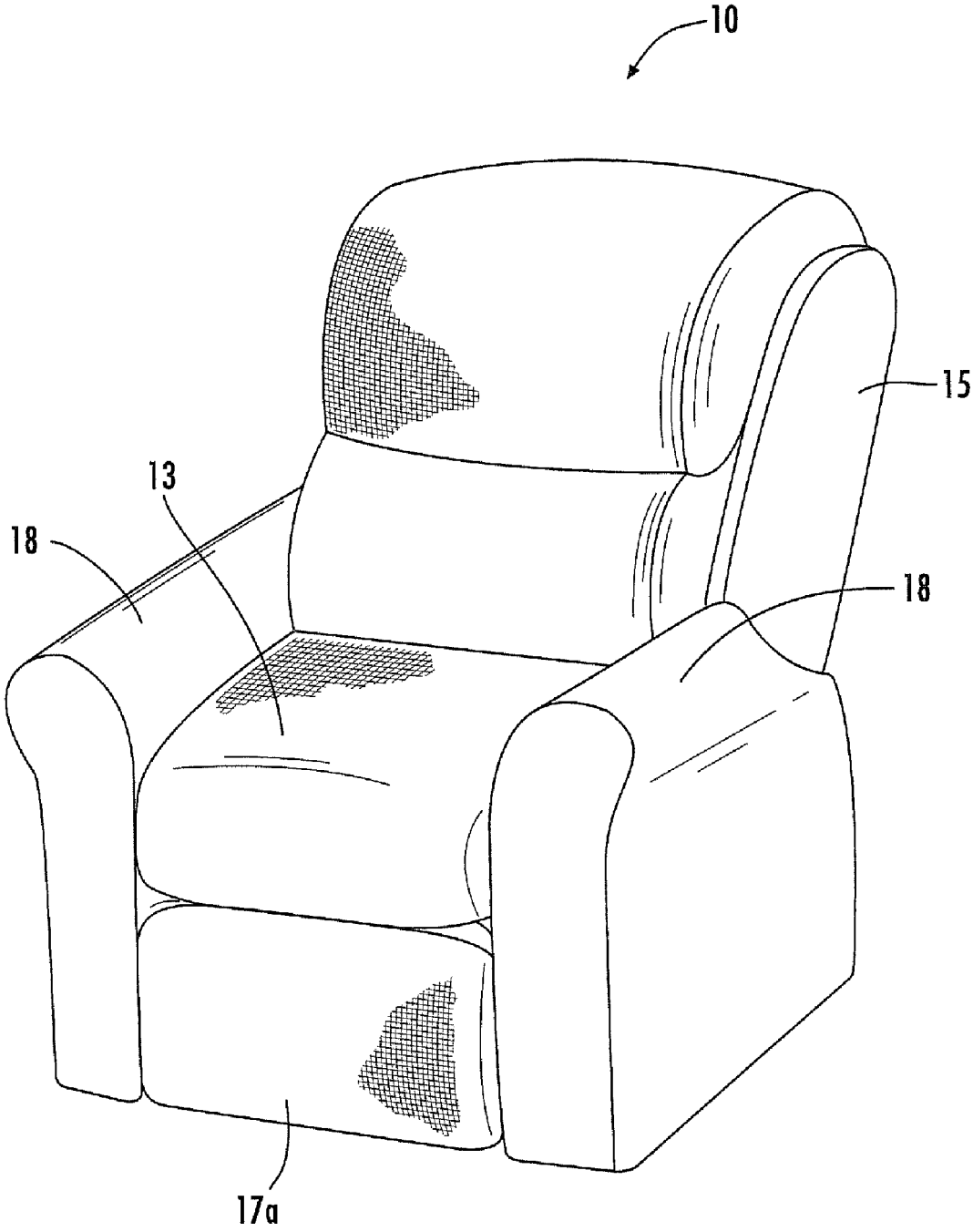
FIG. 1 is a perspective view of a glider-recliner chair according to embodiments of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

This invention is directed to seating units that have a stationary base, a seat portion, and a backrest. As used herein, the terms "forward", "forwardly", and "front" and derivatives thereof refer to the direction defined by a vector extending from the backrest toward the seat parallel to the underlying surface. Conversely, the terms "rearward", "rearwardly", and derivatives thereof refer to the direction directly opposite the forward direction; the rearward direction is defined by a vector that extends from the seat toward the backrest parallel to the underlying surface. The terms "lateral," "laterally", and derivatives thereof refer to the direction parallel with the floor, perpendicular to the forward and rearward directions, and extending away from a plane bisecting the seating units between their armrests. The terms "medial," "inward," "inboard," and derivatives thereof refer to the direction that is the converse of the lateral direction, i.e., the direction parallel with the floor, perpendicular to the forward direction, and extending from the periphery of the seating units toward the aforementioned bisecting plane.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to the figures, a swiveling glider-recliner chair, designated broadly at 10, is illustrated in FIGS. 1-5. The chair 10 includes a base unit 11, a seat 13 that is generally horizontally disposed above the base unit 11, a backrest 15 that is generally vertically and disposed substantially above a rear portion of the seat 13, and two ottomans 17*a*, 17*b*, which, in the upright position of FIG. 1, are generally vertically disposed below a front portion of the seat 13. Arms 18 are positioned on either side of the seat 13 and move in concert with the seat 13.

A pair of mirror image reclining mechanisms 30 (only one of which is shown herein in FIGS. 2-4) are attached to the backrest 15, the seat 13, and the ottomans 17*a*, 17*b*. The reclining mechanisms 30, which comprise a plurality of interconnected links, move the chair 10 between (a) an upright position (FIGS. 1 and 2), in which the seat 13 is generally horizontally disposed, the backrest 15 is generally vertically disposed, and the ottomans 17*a*, 17*b* are generally vertically disposed and positioned below the seat 13, (b) an intermediate TV position (FIG. 3), in which the ottomans 17*a*, 17*b* are generally horizontally disposed in front of the seat 13 and the backrest 15 and the seat 13 substantially maintain the same relationship as they have in the upright position, and (c) a fully reclined position (FIG. 4), in which the angle between the backrest 15 and the seat 13 increases. These components are described in greater detail below.

The base unit 11 includes a circular lower base 12. A swivel unit 14 is mounted onto the top of the lower base 12. Cross-members 18 are mounted atop the swivel unit 14. Those skilled in this art will recognize that the base unit 11 may take other forms that provide mounting locations for the remaining components of the chair 10; for example, the swivel unit 14 may be omitted.

Figure 2:
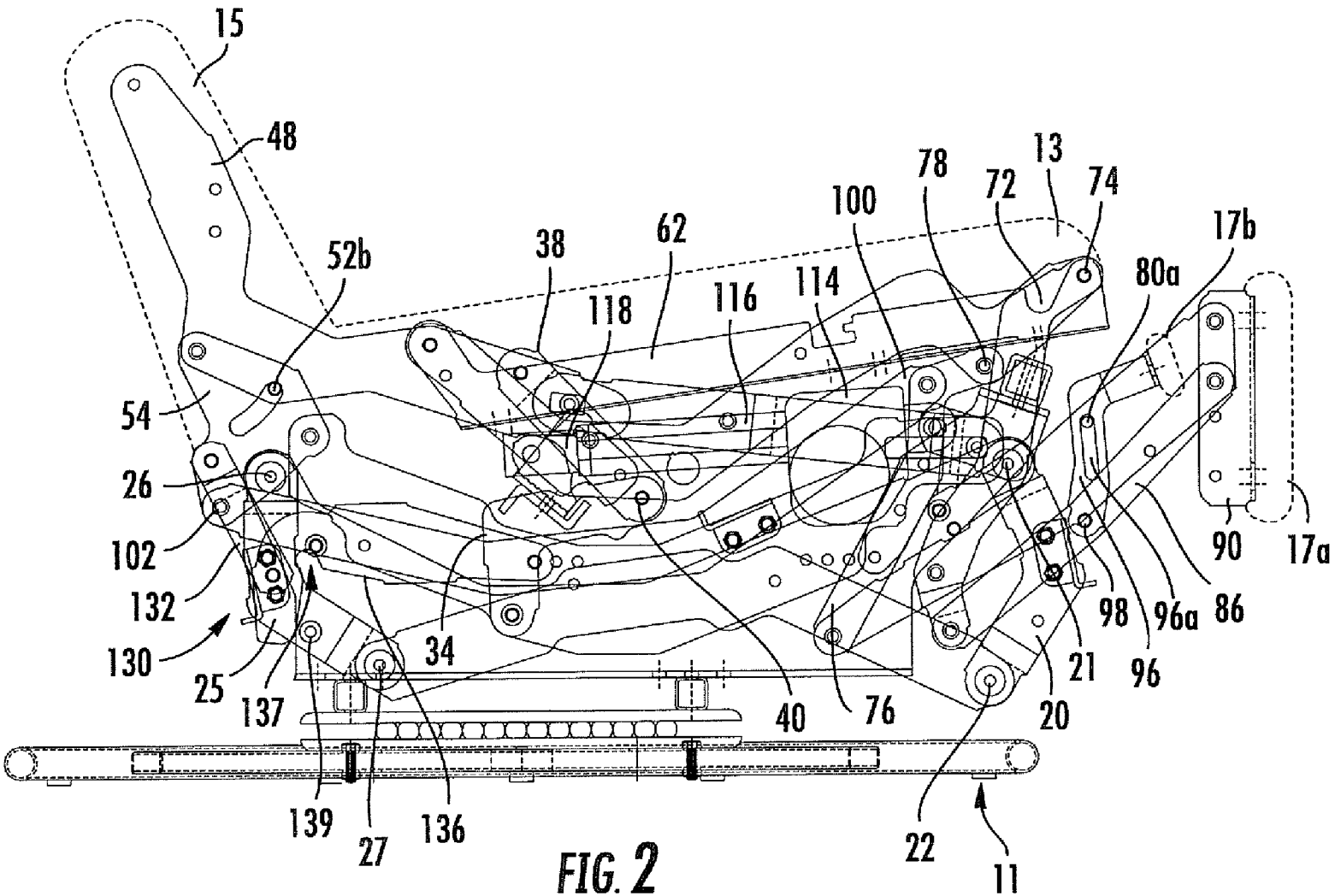
FIG. 2 is a side section view of the chair of FIG. 1 with the chair in its fully upright position.

Glide foundation plates 24 are mounted to the top surfaces of the cross-members 18. A front glide link 20 is attached at a pivot 21 to the front end of the glide foundation plate 24, and a rear glide link 25 is attached at a pivot 26 to the rear end of the glide foundation plate 24. The front and rear glide links 20, 25 are suspended from the glide foundation plate 24 and together form a gliding mechanism 28 that provides a gliding motion to the chair 10 when it is in its upright position (FIG. 2). Those skilled in this art will appreciate that the gliding mechanism may take other forms; it may include glide links of different shapes, or it may include a "track"-based gliding mechanism.

Because the reclining mechanisms 30 are mirror images of each other, only one reclining mechanism will be described in detail herein, with the understanding that the discussion is equally applicable to the mirror image mechanism 30. Also, for clarity the mechanism will be described first with reference to FIG. 4 (with the mechanism 30 in its reclined position), then will be described in its upright and TV positions.

Figure 4:
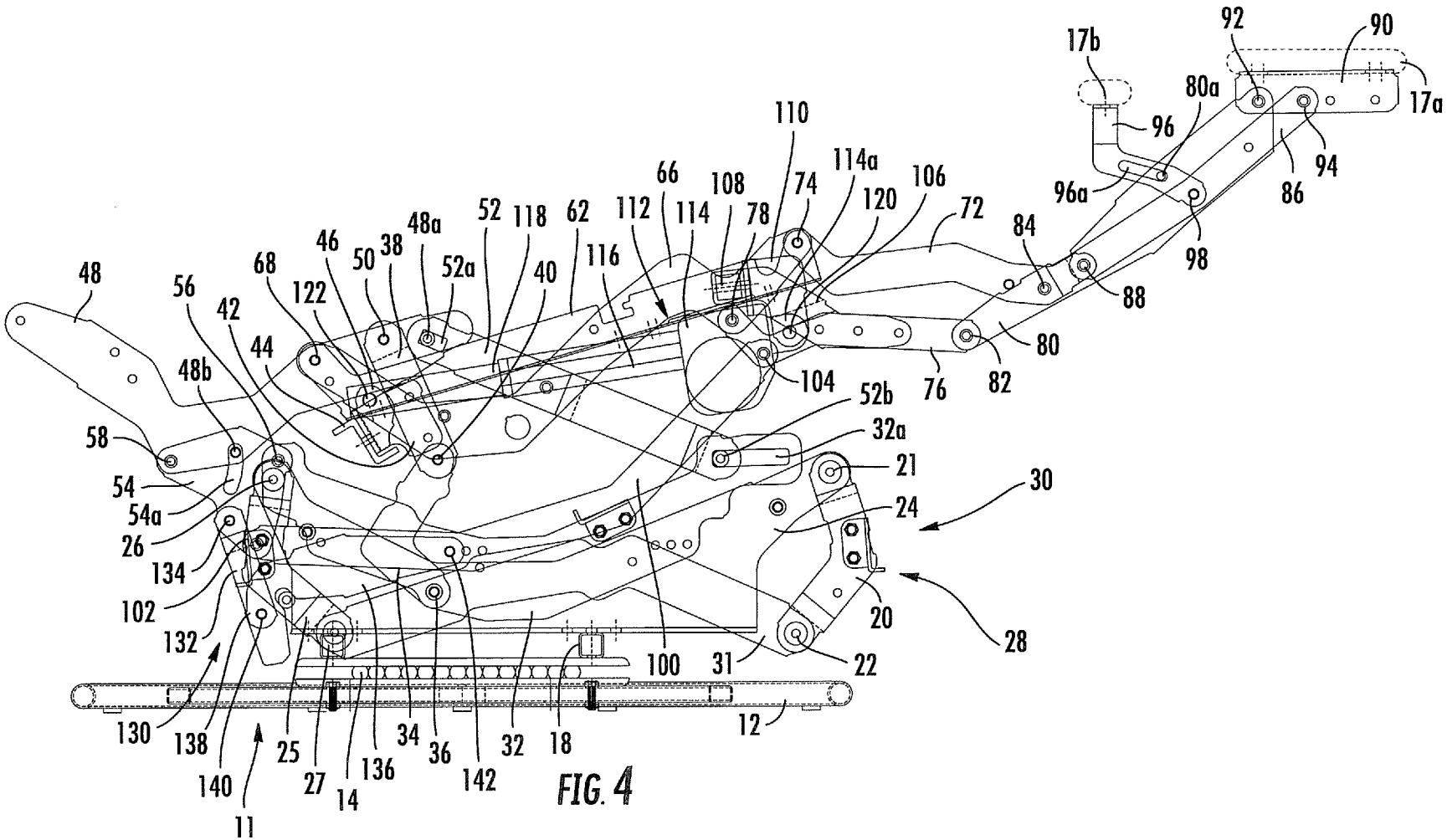
FIG. 4 is a side section view of the chair of FIG. 1 with the chair in its fully reclined position.

Turning now to FIG. 4, the reclining mechanism 30 includes a generally arcuate foundation link 31, which is attached at either end to the front and rear glide links 20, 25 at pivots 22, 27, respectively. A generally crescent-shaped mounting bracket 32 is fixed to the foundation link 31. A slot 32*a* is present at the front end of the mounting bracket 32. An L-shaped lower swing link 34 is attached to a lower region of the mounting bracket 32 at a pivot 36 and extends upwardly and rearwardly, then upwardly and forwardly therefrom. A straight upper swing link 38 is attached at its lower end to the upper end of the lower swing link 34 at a pivot 40 and extends upwardly therefrom.

A backpost 48 is fixed to the backrest 15 and extends generally forwardly from the lower front end of the backrest 15. The upper swing link 38 is attached to a forward portion of the backpost 48 at a pivot 50. A straight coupling link 52 having a slot 52*a* is attached to the backpost 48 via a pin 48*a* located forwardly of the pivot 50. The coupling link 52 extends forwardly and downwardly from the pin 48*a* to attach to the front end of the mounting bracket 32 via a pin 52*b* inserted into a slot 32*a* in the mounting bracket 32. A trapezoidal sequencer plate 54 is attached to the backpost 48 at a pivot 58, and also interacts with the backpost 48 via a slot 54*a* that receives a pin 48*b*. The sequencer plate 54 is also attached to the rear end of the mounting bracket 32 at a pivot 56.

Still referring to FIG. 4, a seat frame 62, to which the arms 18 are mounted, underlies the seat 13. A seat adapter 66 is fixed to the seat frame 62. The seat adapter 66 is attached to the backpost 48 at a pivot 68 that is located just rearward of the pivot 50. An upper ottoman swing link 72 is attached to a front region of the seat adapter 66 at a pivot 74 and extends downwardly and forwardly therefrom. A tripartite lower ottoman swing link 76 is attached to a pivot 78 that is located rearwardly and downwardly from the pivot 74; the lower ottoman swing link 76 extends generally forwardly from the pivot 78. An upper ottoman extension link 80 is attached to the forward end of the lower ottoman swing link 76 at a pivot 82 and extends forwardly and upwardly therefrom. Also the upper ottoman extension link 80 is attached to the upper ottoman swing link at a pivot 84. A lower ottoman extension link 86 is attached to the forward end of the upper ottoman swing link at a pivot 88 that is positioned above and forward of the pivot 84 and extends upwardly and forwardly therefrom generally parallel with the upper ottoman extension link. An outer ottoman bracket 90 is generally horizontally disposed and is attached to the upper and lower ottoman extension links 80, 86 at pivots 92, 94 respectively. The ottoman 17*a* is mounted on the outer ottoman bracket 90.

An L-shaped inner ottoman bracket 96 is attached at its lower, forward end to the lower ottoman extension link 86 at a pivot 98. At its opposite end, the inner ottoman bracket 96 supports the ottoman 17*b*. The inner ottoman bracket 96 also includes a slot 96*a* that receives a pin 80*a* located on the upper ottoman extension link 80.

A connecting link 100 is attached to the sequencer plate 54 at a pivot 102. The connecting link 100 extends forwardly and slightly upwardly from the pivot 102 to a pivot 104 with the lower ottoman swing link 76.

A locking mechanism 130 is attached to the reclining mechanism 30 to prevent gliding of the chair 10 when it is in the TV or fully reclined positions. The locking mechanism 130 includes a drive link 132 that is pivotally interconnected at one end to the sequencer plate 54 at a pivot 134. The drive link 132 is a straight link that slopes downwardly and slightly forwardly from the pivot 134. The opposite end of the drive link 132 is pivotally interconnected with a downwardly-extending projection 138 of a hook-shaped locking link 136 at a pivot 140. The locking link 136 is attached to the mounting bracket 32 at a pivot 142.

The chair 10 includes a power unit 112 that drives the chair 10 between its upright, TV and fully reclined positions. The power unit 112 includes a motor unit 114, to which is attached a sleeve 116. The sleeve extends rearwardly from the motor unit 114 and receives a retractable rod 118. The motor unit 114 is electrically connected with an actuator (not shown), such as a toggle switch or the like, that energizes the motor unit 114 upon actuation.

Figure 5:
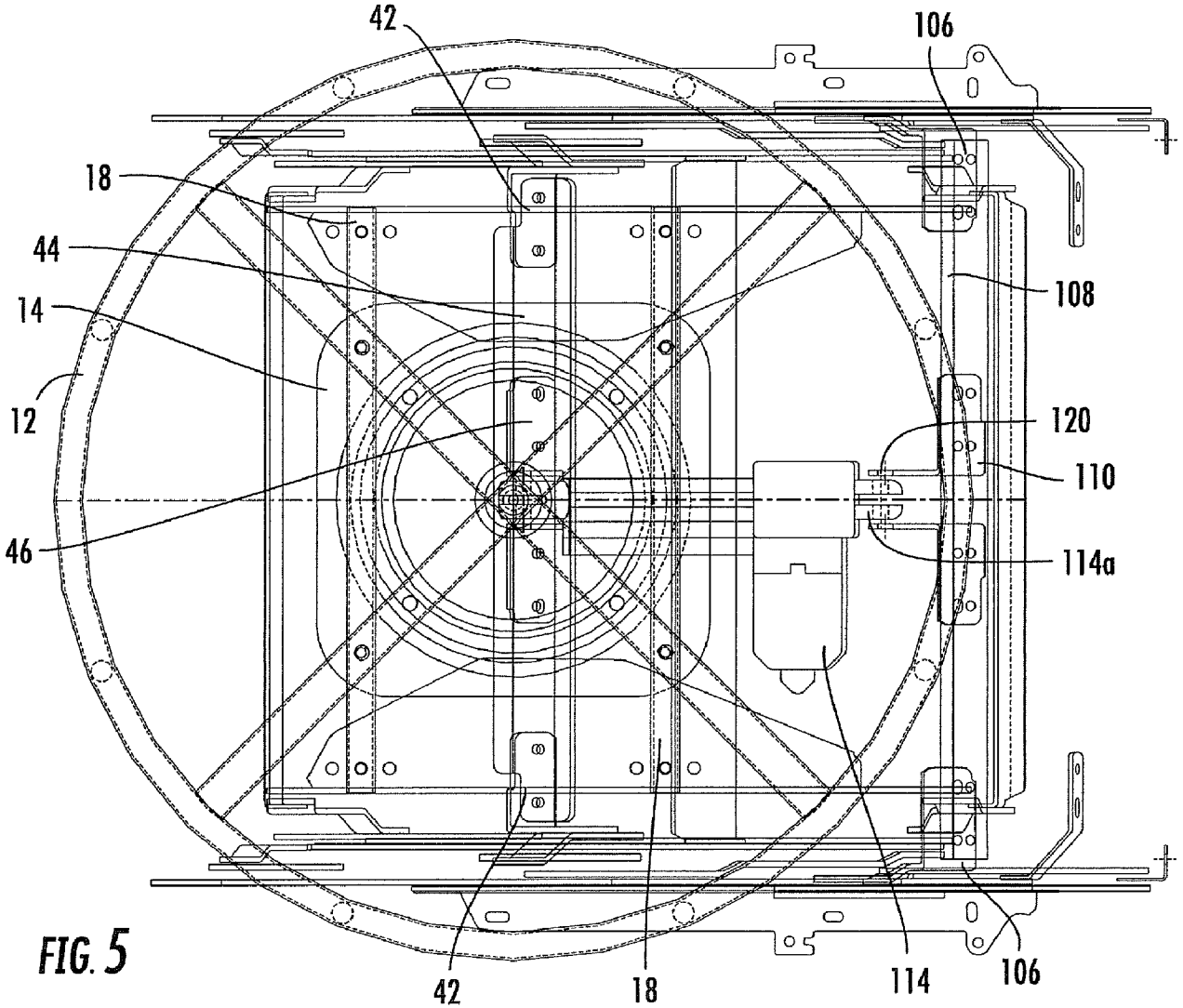
FIG. 5 is a top cutaway view of the frame of the chair of FIG. 1.

The motor unit 114 is attached to a mounting bracket 110 at a pivot 120 via a mounting tab 114*a* (see FIG. 5). The mounting bracket 110 is then attached to a cross-member 108 that extends between the reclining mechanisms 30. A bracket 106 is fixed to each of the lower ottoman swing links 76 and to the cross-member 108.

The rod 118 of the power unit 112 is attached to a bracket 46 (FIG. 5) at a pivot 122. The bracket 46 is then attached to a cross-member 44 that extends between the reclining mechanisms 30; the cross-member 44 is fixed to a bracket 42 that is in turn fixed to the upper swing link 38 of each reclining mechanism 30.

As can be seen in FIG. 2, in the upright position, the rod 118 of the power unit 112 is retracted into the sleeve 116. As a result, a pantographic linkage formed by the upper and lower ottoman swing links 72, 76 and the upper and lower ottoman extension links 80, 86 are folded under the seat frame 62, which positions the ottoman 17*b* underneath a forward portion of the seat frame 62 and the ottoman 17*a* just forward of and below the seat frame 62 in a vertical orientation. Also, the lower and upper swing links 34, 38 are oriented such that the upper segment of the lower swing link 34 is generally horizontal, which positions the backpost 48 and, in turn, the backrest 15, in a generally upright position.

Additionally, the sequencer plate 54 is oriented such that the pivot 102 is located downwardly and rearwardly, such that the locking link 136 of the locking mechanism 130 is raised, with a pocket 137 facing downwardly and positioned above a post 139 on the rear glide link 25. In this position, the chair 10 is free to glide as the front and rear glide links 20, 25 are free to swing on the pivots 21, 26, thereby enabling the reclining mechanisms 30, the seat 13, the backrest 15 and the ottomans 17*a*, 17*b* to move fore-and-aft relative to the base unit 11. During the gliding motion, the majority of the locking mechanism 130 is stationary relative to the reclining mechanisms 30. Because the locking link 136 does not move relative to the reclining mechanism 30 as the chair 10 glides, it does not interact with the post 139.

Figure 3:
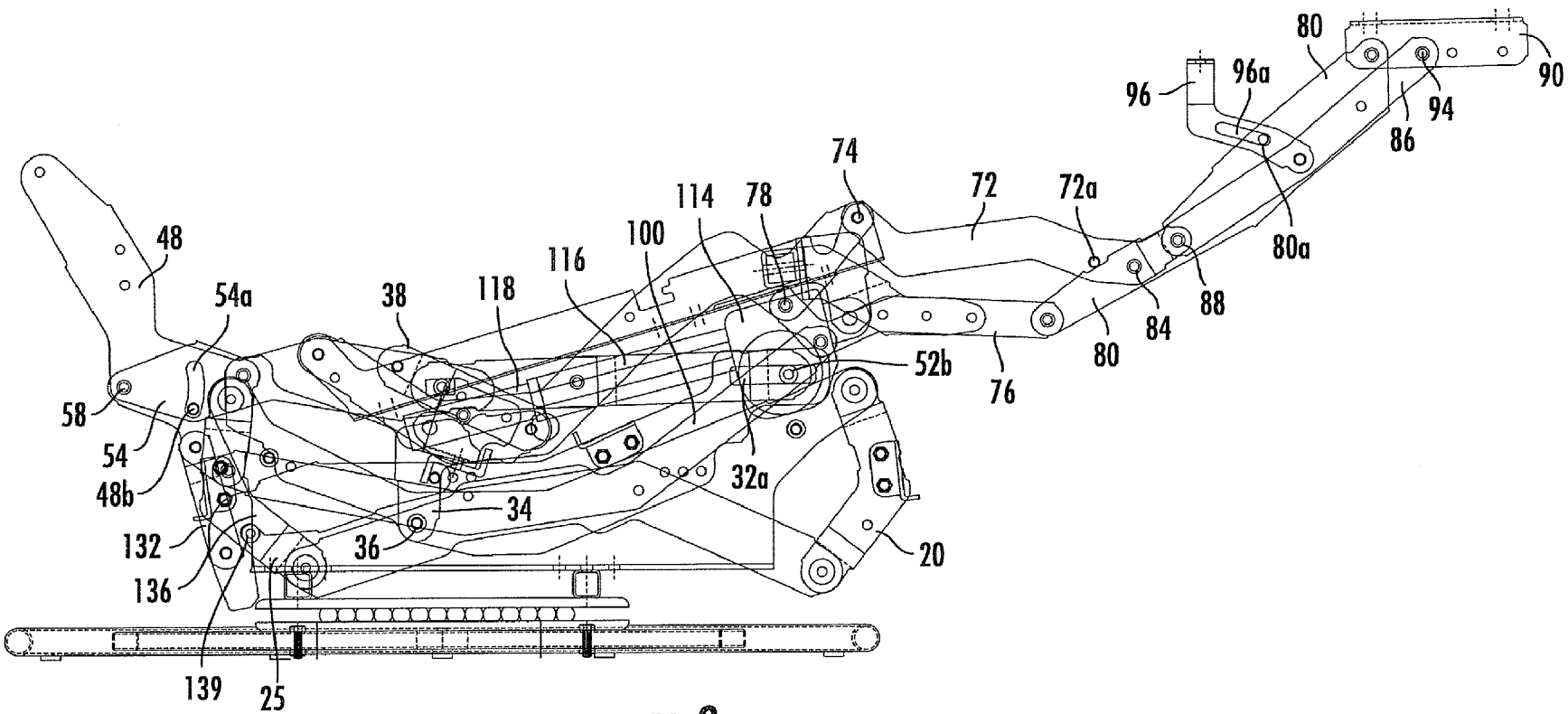
FIG. 3 is a side section view of the chair of FIG. 1 with the chair in its TV position.

To move the chair 10 from the upright position to the TV position of FIG. 3, an occupant of the chair 10 actuates the actuator, which causes the rod 118 to begin to extend from the sleeve 116. Extension of the rod 118 forces the upper swing link 38 to rotate slightly counterclockwise (from the vantage point of FIGS. 2 and 3) about the pivot 40. This movement draws the backpost 48 and rear end of the seat frame 62 downwardly, which causes the seat 13 to increase in pitch angle relative to the underlying surface. However, the weight of the seated occupant prevents further rotation of the upper swing link 38 at this point. Because there is little to no fore-and-aft movement of the rear end of the rod 118, the motor unit 114 moves forwardly relative to the base unit 11, thereby driving the lower ottoman swing link 76 counterclockwise about the pivot 78. Rotation of the lower ottoman swing link 76 forces the upper ottoman extension link 80 forward, which in turn draws the upper ottoman swing link 72 counterclockwise around the pivot 74. Also, the lower ottoman extension link 86 moves forwardly more than the upper ottoman extension link 80, such that the outer ottoman bracket 90 and the inner ottoman bracket 96 rotate counterclockwise (rotation of the inner ottoman bracket 96 causes the pin 80*a* to move in the slot 96*a* toward the pivot 98). The rotation of the outer and inner ottoman brackets 90, 96 induces the ottomans 17*a*, 17*b* to rotate from a vertical orientation to a horizontal orientation. Motion of the ottomans 17*a*, 17*b* ceases when a pin 72*a* on the upper ottoman swing link 72 strikes the upper edge of the upper ottoman extension link 80.

In addition, the rotation of the lower ottoman swing link 76 draws the connecting link 100 forward. Movement of the connecting link 100 rotates the sequencer plate 54 counterclockwise about the pivot 58 with the backpost 48. The drive link 132 of the locking mechanism 130 is driven down and rotates the locking link 136 counterclockwise. The movement of the locking link 136 ceases when the pocket 137 of the locking link 136 descends sufficiently to receive the post 139 on the rear glide link 25. In this position, relative movement between the front and rear glide links 20, 25 and the reclining mechanisms is restrained, thereby preventing the reclining mechanisms 30, and in turn the chair 10, from gliding relative to the base unit 11.

To move the chair 10 from the TV position of FIG. 3 to the fully reclined position of FIG. 4, the occupant can continue to operate the actuator, which extends the rod 118 farther out of the sleeve 116. When the ottomans 17*a*, 17*b* are fully extended, the pivots 84, 88 and 94 are in a near "over-center" condition that helps to lock the ottomans 17*a*, 17*b* in an extended position. Thus, as the rod 118 continues to extend from the sleeve 116 when the chair is in the TV position, the motor unit 114 cannot move forward relative to the base unit 11 any farther, so the rear end of the rod 118 begins to move rearwardly relative to the base unit 11, resulting in clockwise rotation of the upper swing link 38 about the pivot 40. This rotation both drives the lower swing link 34 counterclockwise about the pivot 36 and drives the forward end of the backpost 48 upward. As a consequence, the backpost 48 rotates counterclockwise about the pivot 58 relative to the sequencer plate 54 (and to the seat adapter 66 and the seat frame 62). Rotation of the backpost 48 and, in turn, the backrest 15, continues until (a) the pin 48*b* on the backpost 48 reaches the upper end of the slot 54*a* in the sequencer plate 54 and the pin 52*b* of the coupling link 52 reaches the rear end of the slot 32*a* of the mounting bracket 32. In this position, the backrest 15 has reclined relative to the seat 13 at a greater angle than in the upright and TV positions.

As can also be seen in FIG. 4, the locking mechanism 130 continues to prevent the chair 10 from gliding as the chair 10 moves to the fully reclined position. It can also be seen that the seat 13 rises during movement from the TV position to the fully reclined position.

The chair 10 can be returned to its TV position from the fully reclined position by the occupant operating the actuator in the reverse direction. Because of the over-center condition of the pivots 82, 84, 88, the ottomans 17*a*, 17*b* remain extended, such that retraction of the rod 118 draws the backrest 15 to its upright position. Once the motion of the backrest 15 is complete, the over-center condition of the pivots 84, 88 and 94 can be overcome, and the ottomans 17*a*, 17*b* are able to retract to the upright position.

Those skilled in this art will recognize that other variations of the chair 10 are contemplated in connection with the present invention. For example, the power unit 112 may be reversed, such that the motor 114 is at the rear end of the power unit 112 and the rod 118 is at the front end. In such a case, the rod 118 would extend forwardly relative to the base unit 11 as the chair 10 moved from the upright position to the TV position, and the motor 114 would move rearwardly relative to the base unit 11 when the chair moved from the TV position to the fully reclined position. In either instance, the front end of the power unit 112 moves relative to the base unit 11 during the movement from the upright to the TV position, and the rear end of the power unit moves relative to the base unit 11 during the movement from the TV to the fully reclined position.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

That which is claimed is:

1. A gliding and reclining seating unit, comprising:

a base unit with a first bearing surface;

a generally horizontally-disposed seat positioned above the base unit;

a generally upright backrest positioned above the base unit and substantially rearward of the seat;

an extendable ottoman;

a reclining mechanism attached to the seat, the backrest, the ottoman and the base unit, the reclining mechanism comprising a plurality of pivotally interconnected links;

a gliding mechanism attached to the base unit and the reclining mechanism, the gliding mechanism being configured to enable the seat, backrest and reclining mechanism to glide relative to the base unit along a longitudinal path responsive to a longitudinally-directed force; and a power actuating unit attached to the reclining mechanism, the actuating unit configured to move the seating unit between (a) an upright position, in which the seat is generally horizontally disposed, the backrest is generally vertically disposed, and the ottoman is generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases.

2. The seating unit defined in claim 1, wherein the reclining mechanism includes a pantographic linkage on which the ottoman is mounted, and wherein in the TV and fully reclined positions, pivots between links of the pantographic linkage form a near over-center arrangement that locks the ottoman in position.

3. The seating unit defined in claim 1, further comprising a locking mechanism that allows the seating unit to glide while in the upright position but prevents gliding of the seating unit while in the TV and fully reclined positions.

4. The seating unit defined in claim 1, wherein the power actuating unit includes opposed first and second ends, and wherein the first end of the power actuating unit moves forwardly as the seating unit moves from the upright position to the TV position, and wherein the second end of the power actuating unit moves rearwardly when the seating unit moves from the TV position to the fully reclined position.

5. The seating unit defined in claim 4, wherein the reclining mechanism includes a lower swing link pivotally attached with the base unit and an upper swing link pivotally attached with the lower swing link and with the backrest, and wherein the second end of the power actuating unit is attached with the upper swing link.

6. The seating unit defined in claim 4, wherein the power actuating unit includes a motor and an extendable member at the first and second ends.

7. The seating unit defined in claim 1, wherein the seat rises in moving from the TV position to the fully reclined position.

8. The seating unit defined in claim 1, wherein the base unit further comprises a swivel unit.

9. The seating unit defined in claim 1, wherein the reclining mechanism includes a backpost that is fixed relative to the backrest, a mounting bracket that is fixed relative to the gliding mechanism and pivotally attached to the backpost, and a seat adapter that is fixed relative to the seat and pivotally attached to the backpost.

10. A gliding and reclining seating unit, comprising:

a base unit with a first bearing surface;

a generally horizontally-disposed seat positioned above the base unit;

a generally upright backrest positioned above the base unit and substantially rearward of the seat;

an extendable ottoman;

a reclining mechanism attached to the seat, the backrest, the ottoman and the base unit, the reclining mechanism comprising a plurality of pivotally interconnected links;

a gliding mechanism attached to the base unit and the reclining mechanism, the gliding mechanism being configured to enable the seat, backrest and reclining mechanism to glide relative to the base unit along a longitudinal path responsive to a longitudinally-directed force; and a linear actuator attached to the reclining mechanism, the linear actuator configured to move the seating unit between (a) an upright position, in which the seat is generally horizontally disposed, the backrest is generally vertically disposed, and the ottoman is generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases.

11. The seating unit defined in claim 10, wherein the reclining mechanism includes a pantographic linkage on which the ottoman is mounted, and wherein in the TV and fully reclined positions, pivots between links of the pantographic linkage form a near over-center arrangement that locks the ottoman in position.

12. The seating unit defined in claim 10, further comprising a locking mechanism that allows the seating unit to glide on the gliding mechanism while in the upright position but prevents gliding of the seating unit while in the TV and fully reclined positions.

13. The seating unit defined in claim 10, further comprising a swivel unit attached to the base unit.

14. The seating unit defined in claim 10, wherein the reclining mechanism includes a backpost that is fixed relative to the backrest, a mounting bracket that is fixed relative to the gliding mechanism and pivotally attached to the backpost, and a seat adapter that is fixed relative to the seat pivotally attached to the backpost.

15. The seating unit defined in claim 10, wherein the seat rises in moving from the TV position to the fully reclined position.

16. A gliding and reclining seating unit, comprising:

a base unit with a first bearing surface;

a generally horizontally-disposed seat positioned above the base unit;

a generally upright backrest positioned above the base unit and substantially rearward of the seat;

an extendable ottoman;

a reclining mechanism attached to the seat, the backrest, the ottoman and the base unit, the reclining mechanism comprising a plurality of pivotally interconnected links;

a gliding mechanism attached to the base unit and the reclining mechanism, the gliding mechanism being configured to enable the seat, backrest and reclining mechanism to glide relative to the base unit along a longitudinal path responsive to a longitudinally-directed force; and a linear power actuating unit attached to the reclining mechanism, the actuating unit configured to move the seating unit between (a) an upright position, in which the seat is generally horizontally disposed, the backrest is generally vertically disposed, and the ottoman are generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases;

wherein the linear actuator includes opposed first and second ends, and wherein the first end of the linear actuator moves forwardly as the seating unit moves from the upright position to the TV position, and wherein the second end of the linear actuator moves rearwardly when the seating unit moves from the TV position to the fully reclined position.

17. The seating unit defined in claim 16, wherein the reclining mechanism includes a lower swing link pivotally attached with the base unit and an upper swing link pivotally attached with the lower swing link and with the backrest, and wherein the second end of the linear actuator is attached with the upper swing link.

18. A gliding and reclining seating unit, comprising:

a base unit with a first bearing surface;

a generally horizontally-disposed seat positioned above the base unit;

a generally upright backrest positioned above the base unit and substantially rearward of the seat;

an extendable ottoman;

a reclining mechanism attached to the seat, the backrest, the ottoman and the base unit, the reclining mechanism comprising a plurality of pivotally interconnected links;

a gliding mechanism attached to the base unit and the reclining mechanism, the gliding mechanism being configured to enable the seat, backrest and reclining mechanism to glide relative to the base unit along a longitudinal path responsive to a longitudinally-directed force; and a linear actuator attached to the reclining mechanism, the linear actuator configured to move the seating unit between (a) an upright position, in which the seat is generally horizontally disposed, the backrest is generally vertically disposed, and the ottoman is generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases;

wherein the reclining mechanism includes a pantographic linkage on which the ottoman is mounted, and wherein in the TV and fully reclined positions, pivots between links of the pantographic linkage form a near over-center arrangement that locks the ottoman in position; and wherein the reclining mechanism includes a backpost that is fixed relative to the backrest, a mounting bracket that is fixed relative to the gliding mechanism and pivotally attached to the backpost, and a seat adapter that is fixed relative to the seat and pivotally attached to the backpost.

19. The seating unit defined in claim 18, wherein the linear actuator includes opposed first and second ends, and wherein the first end of the linear actuator moves forwardly as the seating unit moves from the upright position to the TV position, and wherein the second end of the linear actuator moves rearwardly when the seating unit moves from the TV position to the fully reclined position.

20. The seating unit defined in claim 19, wherein the reclining mechanism includes a lower swing link pivotally attached with the base unit and an upper swing link pivotally attached with the lower swing link and with the backrest, and wherein the second end of the linear actuator is attached with the upper swing link.

21. A gliding and reclining seating unit, comprising:

a base unit with a first bearing surface;

a generally horizontally-disposed seat positioned above the base unit;

a generally upright backrest positioned above the base unit and substantially rearward of the seat;

an extendable ottoman;

a reclining mechanism attached to the seat, the backrest, the ottoman and the base unit, the reclining mechanism comprising a plurality of pivotally interconnected links;

a gliding mechanism attached to the base unit and the reclining mechanism, the gliding mechanism being configured to enable the seat, backrest and reclining mechanism to glide relative to the base unit along a longitudinal path responsive to a longitudinally-directed force; and a power actuating unit attached to the reclining mechanism, the actuating unit configured to move the chair between (a) an upright position, in which the seat is generally horizontally disposed, the backrest is generally vertically disposed, and the ottoman is generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases;

wherein the reclining mechanism includes a backpost fixed relative to the backrest and a sequencer plate pivotally interconnected with the backrest and with others of the plurality of pivotally interconnected links of the reclining mechanism, and wherein the sequencer plate rotates in a first rotative direction relative to the backrest when the seating unit moves from the upright position to the TV position, and wherein the backrest rotates relative to the sequencer plate in the first rotative direction when the seating unit moves from the TV position to the fully reclined position.

22. The seating unit defined in claim 21, wherein the backrest includes one of a pin and a slot, and the sequencer plate includes the other of a pin and a slot, the pin being received in the slot.

23. The seating unit defined in claim 22, wherein the backrest includes the pin, and the sequencer plate includes the slot.

* * * * *